US009840383B2

(12) United States Patent
Hu et al.

(10) Patent No.: US 9,840,383 B2
(45) Date of Patent: Dec. 12, 2017

(54) PAPER MONEY DISTRIBUTING DEVICE AND REVERSING WHEEL SET THEREOF

(71) Applicant: GRG BANKING EQUIPMENT CO., LTD., Guangzhou, Guangdong (CN)

(72) Inventors: Xing Hu, Guangdong (CN); Guihong Zhou, Guangdong (CN); Wei Zhang, Guangdong (CN); Zhan Liu, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/522,223

(22) PCT Filed: Aug. 7, 2015

(86) PCT No.: PCT/CN2015/086314
§ 371 (c)(1),
(2) Date: Apr. 26, 2017

(87) PCT Pub. No.: WO2016/070661
PCT Pub. Date: May 12, 2016

(65) Prior Publication Data

US 2017/0313531 A1 Nov. 2, 2017

(30) Foreign Application Priority Data

Nov. 3, 2014 (CN) ..... 2014 1 0613992

(51) Int. Cl.
*B65H 3/06* (2006.01)
*G07D 11/00* (2006.01)
*B65H 3/52* (2006.01)

(52) U.S. Cl.
CPC ..... *B65H 3/06* (2013.01); *B65H 3/52* (2013.01); *B65H 3/523* (2013.01); *B65H 3/5207* (2013.01);
(Continued)

(58) Field of Classification Search
CPC ..... B65H 3/06; B65H 3/52; B65H 3/5207; B65H 3/5215; B65H 3/523;
(Continued)

(56) References Cited

U.S. PATENT DOCUMENTS 8,579,275 B1 * 11/2013 Tsai ..... B65H 29/14 271/186
8,998,208 B1 * 4/2015 Hong ..... B65G 13/06 271/314
(Continued)

FOREIGN PATENT DOCUMENTS

CN 1661253 A 8/2005
CN 1684891 A 10/2005
(Continued)

OTHER PUBLICATIONS

International Search Report for PCT/CN2015/086314, dated Nov. 10, 2015, ISA/CN.

*Primary Examiner* — David H Bollinger
(74) *Attorney, Agent, or Firm* — U.S. Fairsky LLP; Yue Xu

(57) ABSTRACT

A banknote separating device is applicable for a financial self-service equipment, includes a banknote separating wheel set and a reverse wheel set for cooperating with the banknote separating wheel set, and the reverse wheel set includes a reverse-wheel-set rotating shaft, a reverse wheel fixing frame, and a reverse wheel assembly. One end of the reverse wheel assembly sequentially passes through an E-shaped snap ring, a flanged bearing, a one-way bearing stop ring and a one-way bearing to be mounted to the reverse wheel fixing frame, and the one-way bearing and the reverse wheel fixing frame are coupled by the one-way bearing stop ring to form a stationary rigid body, and the one-way bearing stop ring is in contact with only an outer ring of the flanged bearing.

10 Claims, 4 Drawing Sheets

(52) U.S. Cl.
CPC ..... *B65H 3/5215* (2013.01); *G07D 11/006* (2013.01); *B65H 2701/1912* (2013.01)

(58) Field of Classification Search
CPC ..... B65H 2403/70; B65H 2403/72; B65H 2403/732; B65H 2701/1912; G07D 11/006
See application file for complete search history.

(56) References Cited

U.S. PATENT DOCUMENTS

| | | | | |
|---|---|---|---|---|
| 2004/0061274 | A1 | 4/2004 | Tsunematsu | |
| 2005/0189191 | A1 | 9/2005 | Tomita et al. | |
| 2013/0119598 | A1* | 5/2013 | Kuo | B65H 9/006 271/10.11 |
| 2014/0125002 | A1* | 5/2014 | Itabashi | B65H 5/068 271/10.13 |
| 2015/0123340 | A1* | 5/2015 | Kannari | B65H 3/0669 271/117 |

FOREIGN PATENT DOCUMENTS

| | | | |
|---|---|---|---|
| CN | 201654835 | U | 11/2010 |
| CN | 202022599 | U | 11/2011 |
| CN | 103646465 | A | 3/2014 |
| CN | 103700185 | A | 4/2014 |
| CN | 203781421 | U | 8/2014 |
| CN | 104355144 | A | 2/2015 |
| JP | 2005126213 | A | 5/2005 |
| JP | 2009029559 | A | 2/2009 |

* cited by examiner

PAPER MONEY DISTRIBUTING DEVICE AND REVERSING WHEEL SET THEREOF

This application is the national phase of International Application No. PCT/CN2015/086314, titled "PAPER MONEY DISTRIBUTING DEVICE AND REVERSING WHEEL SET THEREOF", filed on Aug. 7, 2015, which claims the benefit of priority to Chinese patent application No. 201410613992.5 titled "BANKNOTE SEPARATING DEVICE AND REVERSE WHEEL SET THEREOF", filed with the Chinese State Intellectual Property Office on Nov. 3, 2014, the entire disclosures of which are incorporated herein by reference.

FIELD

The present application relates to the technology of financial self-service equipment, and particularly to a banknote separating device and a method for fixing a one-way bearing of a reverse wheel set of the banknote separating device.

BACKGROUND

Currently, a one-way bearing is generally used in banknote separating mechanisms of financial equipment, and functions to restrict a banknote separating reverse wheel from rotating in a banknote-feeding direction, and only allow the banknote separating reverse wheel to rotate in a direction opposite to the banknote-feeding direction.

Currently, one-way bearings are generally fixed by a way shown in FIG. 1. The reverse wheel set includes a reverse wheel rotating shaft 1, a reverse wheel fixing frame 2, an E-shaped snap ring 3, a one-way bearing housing 4, a one-way bearing 5, a flanged bearing 6, a reverse wheel assembly 7 and a spacer 8. The way for fixing the one-way bearing 5 may be understood as follows. The reverse wheel rotating shaft 1, the reverse wheel fixing frame 2, the one-way bearing housing 4, the one-way bearing 5, an outer ring of the flanged bearing 6, and the spacer 8 are each a stationary end, and the reverse wheel assembly 7, the E-shaped snap ring, and an inner ring of the flanged bearing 6 are each a movable end.

In this fixing way, an end surface of the E-shaped snap ring of the movable end will squeeze and contact with an end surface of the one-way bearing 5 of the stationary end, thereby generating a friction resistance, which restricts the reverse wheel assembly 7 from rotating freely. If the friction resistance is too large, the reverse wheel assembly 7 even cannot rotate. In case that the reverse wheel assembly 7 rotates unsmoothly or is incapable of rotation, a rubber portion of the reverse wheel assembly is apt to be partially abraded, which may enlarge a banknote separating gap. This defect, in a less severe case, may cause that the service life of the banknote separating device is significantly reduced and the banknote separating gap needs to be frequently adjusted, and in a severe case, may cause failure of the banknote separating function, which cannot meet the design requirement.

SUMMARY

For eliminating the defects in the conventional technology that the reverse wheel assembly rotates unsmoothly or is incapable of rotation due to the friction resistance, a banknote separating device is provided according to the present application, in which, a one-way bearing of a reverse wheel set of the banknote separating device is fixed by a new way, which effectively achieves separation of movement of a stationary end from movement of a movable end in the one-way bearing, thereby prolonging the service life of the banknote separating device and ensuring the reliability of its function.

The banknote separating device according to the present application is applicable for a financial self-service equipment, the banknote separating device includes a banknote separating wheel set and a reverse wheel set for cooperating with the banknote separating wheel set, and the reverse wheel set includes a reverse-wheel-set rotating shaft, a reverse wheel fixing frame, and a reverse wheel assembly. One end of the reverse wheel assembly sequentially passes through an E-shaped snap ring, a flanged bearing, a one-way bearing stop ring and a one-way bearing to be mounted to the reverse wheel fixing frame, wherein the one-way bearing and the reverse wheel fixing frame are coupled by the one-way bearing stop ring to form a stationary rigid body, and the one-way bearing stop ring is in contact with only an outer ring of the flanged bearing.

Preferably, an outer peripheral surface of the one-way bearing stop ring is provided with a protruding strip extending in an axial direction of the one-way bearing stop ring, the reverse wheel fixing frame is provided with a groove for fitting with the protruding strip, and in an assembled state, the protruding strip of the one-way bearing stop ring is embedded into the groove of the reverse wheel fixing frame.

Preferably, one end of the protruding strip protrudes from a first side of the one-way bearing stop ring, an outer peripheral surface of the one-way bearing is provided with a groove for fitting with the protruding strip, and in the assembled state, the one-way bearing is located at the first side of the one-way bearing stop ring, and an end, protruding from the first side of the one-way bearing stop ring, of the protruding strip is embedded into the groove in the outer peripheral surface of the one-way bearing.

Preferably, the one-way bearing stop ring includes a second side opposite to the first side, an outer peripheral portion of the second side is configured as a flange, and in the assembled state, the flanged bearing is located at the second side of the one-way bearing stop ring, and the flange is in contact with the outer ring of the flanged bearing.

Preferably, another end of the reverse wheel assembly sequentially passes through an E-shaped snap ring, a flanged bearing, and a spacer to be mounted to the reverse wheel fixing frame.

A reverse wheel set is further provided according to the present application, which is applicable for a banknote separating device of a financial self-service equipment, the reverse wheel set includes a reverse-wheel-set rotating shaft, a reverse wheel fixing frame, and a reverse wheel assembly. One end of the reverse wheel assembly sequentially passes through an E-shaped snap ring, a flanged bearing, a one-way bearing stop ring and a one-way bearing to be mounted to the reverse wheel fixing frame, wherein the one-way bearing and the reverse wheel fixing frame are coupled by the one-way bearing stop ring to form a stationary rigid body, and the one-way bearing stop ring is in contact with only an outer ring of the flanged bearing.

Preferably, an outer peripheral surface of the one-way bearing stop ring is provided with a protruding strip extending in an axial direction of the one-way bearing stop ring, the reverse wheel fixing frame is provided with a groove for fitting with the protruding strip, and in an assembled state, the protruding strip of the one-way bearing stop ring is embedded into the groove of the reverse wheel fixing frame.

Preferably, one end of the protruding strip protrudes from a first side of the one-way bearing stop ring, an outer peripheral surface of the one-way bearing is provided with a groove for fitting with the protruding strip, and in the assembled state, the one-way bearing is located at the first side of the one-way bearing stop ring, and an end, protruding from the first side of the one-way bearing stop ring, of the protruding strip is embedded into the groove in the outer peripheral surface of the one-way bearing.

Preferably, the one-way bearing stop ring includes a second side opposite to the first side, an outer peripheral portion of the second side is configured as a flange, and in the assembled state, the flanged bearing is located at the second side of the one-way bearing stop ring, and the flange is in contact with the outer ring of the flanged bearing.

Preferably, another end of the reverse wheel assembly sequentially passes through an E-shaped snap ring, a flanged bearing, and a spacer to be mounted to the reverse wheel fixing frame.

In the banknote separating device according to the present application, one end of the reverse wheel assembly sequentially passes through an E-shaped snap ring, a flanged bearing, a one-way bearing stop ring and a one-way bearing to be mounted to the reverse wheel fixing frame. The reverse-wheel-set rotating shaft, the reverse wheel fixing frame, the one-way bearing stop ring, the one-way bearing and the outer ring of the flanged bearing constitute a stationary end, and the reverse wheel assembly, the E-shaped snap ring and the inner ring of the flanged bearing constitute a movable end. Due to the arrangement of the one-way bearing stop ring, the movements of the stationary end and the movable end of the one-way bearing are separated. Specifically, the protruding strip on the one-way bearing stop ring is embedded respectively into the groove in the reverse wheel fixing frame and the groove in the one-way bearing, thus the one-way bearing, the one-way bearing stop ring and the reverse wheel fixing frame are coupled to form a stationary rigid body. Further, the one-way bearing stop ring is in contact with only the outer ring of the flanged bearing by its protruding strip, thus the whole stationary end can be prevented from generating any friction with the movable end, which achieves the separation of the stationary end from the movable end, and thereby the reverse wheel assembly can rotate freely and smoothly without being subjected to any friction resistance during the rotation.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION

Figure 1:
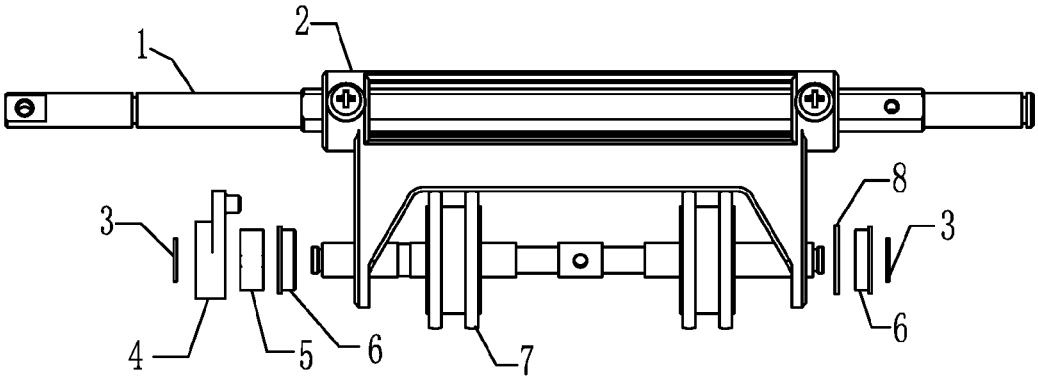
FIG. 1 is a schematic perspective exploded view showing the structure of a reverse wheel set in the conventional technology.
Figure 2:
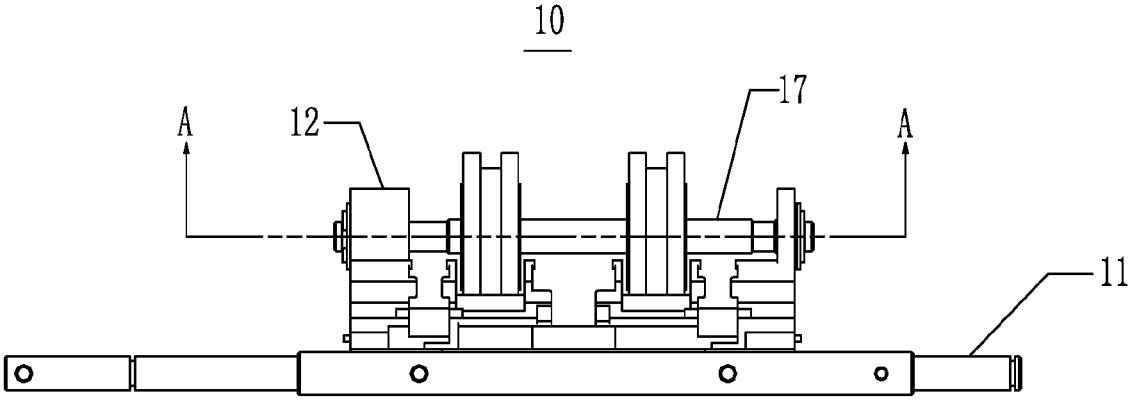
FIG. 2 is a schematic perspective view showing the structure of a reverse wheel set according to a preferred embodiment of the present application.
Figure 3:
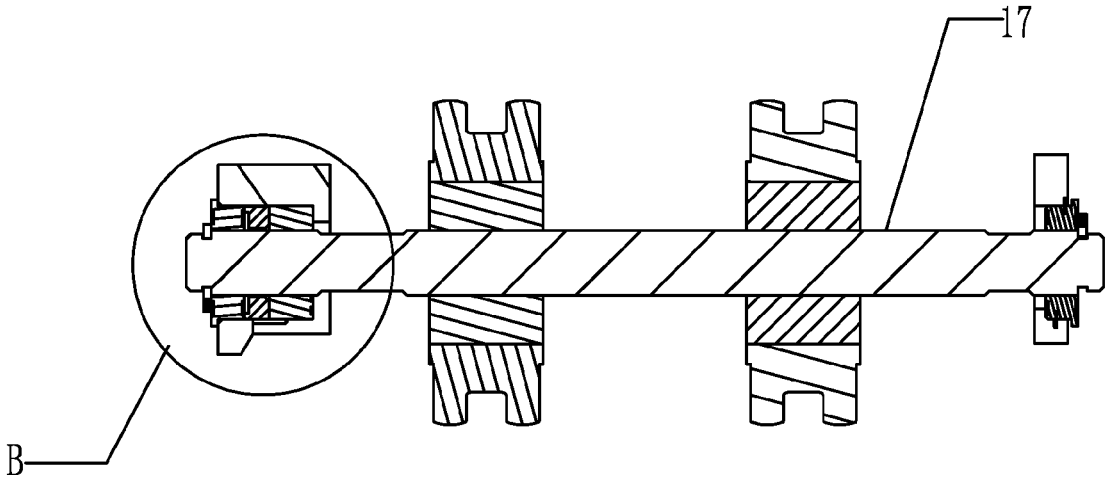
FIG. 3 is a sectional view of the reverse wheel set in FIG. 2 taken along line A-A.

For further elaborating a banknote separating device and a method for fixing a one-way bearing of a reverse wheel set of the banknote separating device according to the present application, an embodiment of the present application is described in detail in conjunction with drawings.

The banknote separating device according to this embodiment includes a banknote separating wheel set and a reverse wheel set cooperating with the banknote separating wheel set. Since the banknote separating device according to this embodiment is characterized in the reverse wheel set, only the structure of the reverse wheel set is described in detail in this embodiment. Referring to FIGS. 2 to 5, the reverse wheel set 10 includes a reverse-wheel-set rotating shaft 11, a reverse wheel fixing frame 12 and a reverse wheel assembly 17. One end of the reverse wheel assembly 17 sequentially passes through an E-shaped snap ring 13, a flanged bearing 14, a one-way bearing stop ring 15 and a one-way bearing 16 to be mounted to the reverse wheel fixing frame 12. Another end of the reverse wheel assembly 17 sequentially passes through an E-shaped snap ring 13, a flanged bearing 14 and a spacer 18 to be mounted to the reverse wheel fixing frame. The one-way bearing 16 and the reverse wheel fixing frame 12 are coupled by the one-way bearing stop ring 15 to form a stationary rigid body, and the one-way bearing stop ring 15 is in contact with only an outer ring of the flanged bearing 14.

Figure 4:
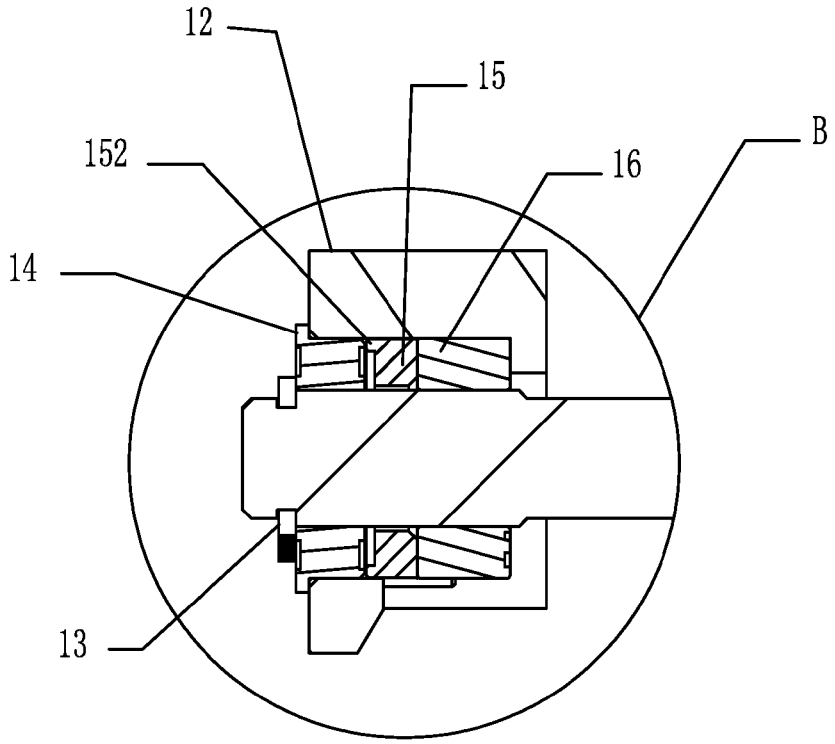
FIG. 4 is an enlarged view of part B in FIG. 3.
Figure 5:
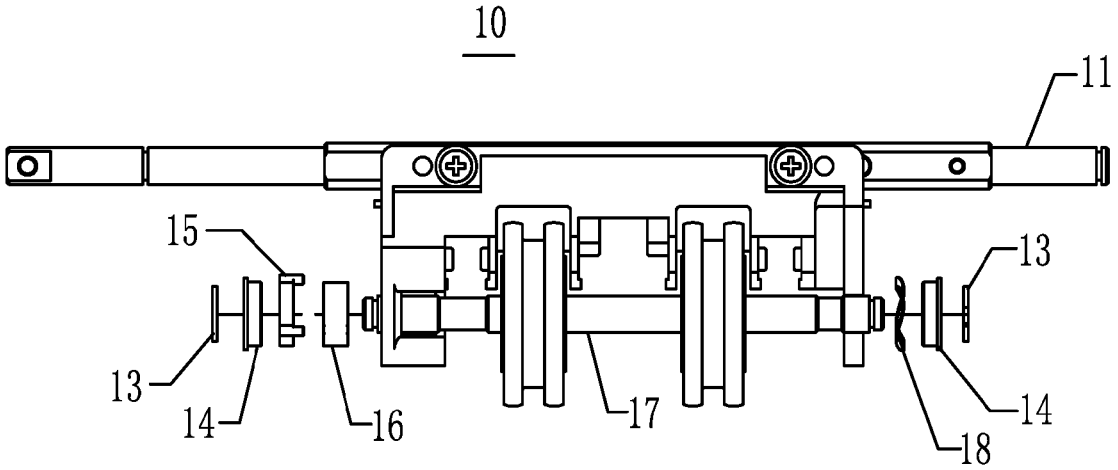
FIG. 5 is an exploded view of the reverse wheel set in FIG. 2.
Figure 6:
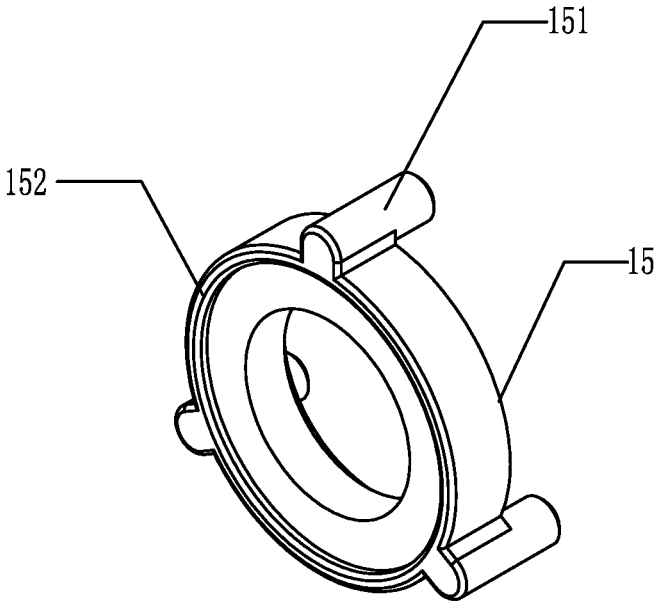
FIG. 6 is a schematic perspective view showing the structure of a one-way bearing stop ring in FIG. 5.
Figure 7:
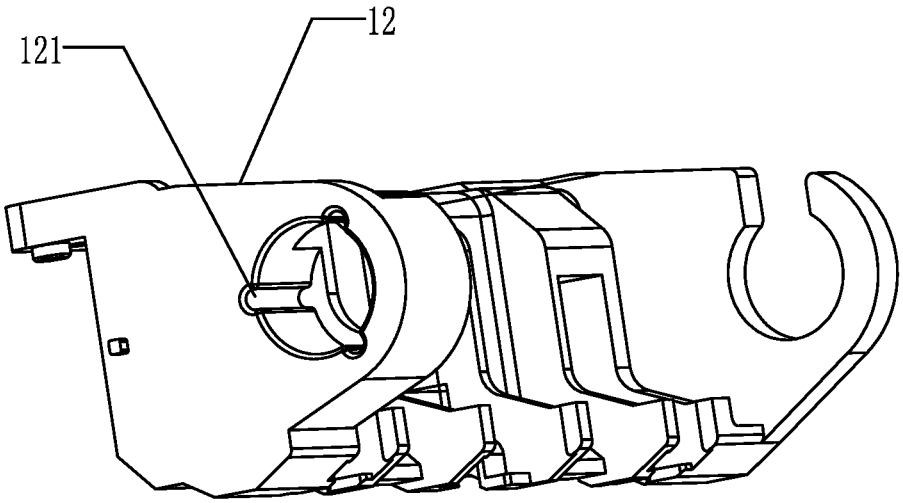
FIG. 7 is a schematic perspective view showing the structure of a reverse wheel fixing frame in FIG. 5.
Figure 8:
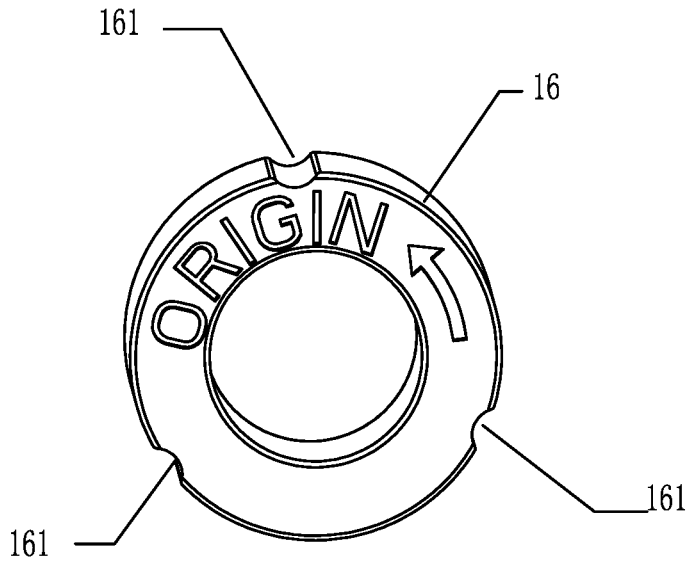
FIG. 8 is a schematic perspective view showing the structure of a one-way bearing in FIG. 5.

In this embodiment, as shown in FIGS. 6 and 7, an outer peripheral surface of the one-way bearing stop ring 15 is provided with a protruding strip 151 extending in an axial direction of the one-way bearing stop ring, and the reverse wheel fixing frame 12 is provided with a groove 121 for fitting with the protruding strip. In an assembled state, as shown in FIG. 4, the protruding strip 151 of the one-way bearing stop ring 15 is embedded into the groove 121 of the reverse wheel fixing frame 12. One end of the protruding strip 151 protrudes from a first side of the one-way bearing stop ring 15, and an outer peripheral surface of the one-way bearing 16 is provided with a groove 161 for fitting with the protruding strip 151, as shown in FIG. 8. In an assembled state, the one-way bearing 16 is located at the first side of the one-way bearing stop ring 15, and the end, protruding from the first side of the one-way bearing stop ring 15, of the protruding strip 151 is embedded into the groove 161 in the outer peripheral surface of the one-way bearing 16. With the arrangement of the protruding strip 151, the one-way bearing stop ring 15 couples the one-way bearing 16 and the reverse wheel fixing frame 12 to form the stationary rigid body. The design of the protruding strip may be equivalently varied, which is not limited to the structure illustrated in the drawings.

Figure 9:
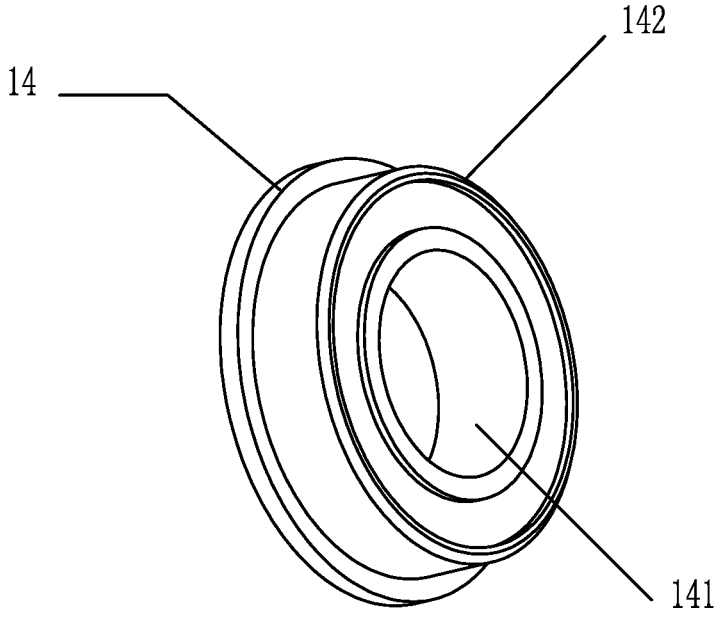
FIG. 9 is a schematic perspective view showing the structure of a flanged bearing in FIG. 5.

In addition, the one-way bearing stop ring 15 includes a second side opposite to the first side, and an outer peripheral portion at the second side is configured as a flange 152. In an assembled state, the flanged bearing 14 is located at the second side of the one-way bearing stop ring 15, and the flange 152 is in contact with the outer ring of the flanged bearing 14, and reference may be made to FIG. 4. The flanged bearing 14 includes an inner ring 141 and an outer ring 142, as shown in FIG. 9. With the design of the flange 152, the one-way bearing stop ring 15 is in contact with the outer ring of the flanged bearing 14.

In this embodiment, the reverse-wheel-set rotating shaft 11, the reverse wheel fixing frame 12, the one-way bearing stop ring 15, the one-way bearing 16 and the outer ring 142 of the flanged bearing constitute a stationary end. The reverse wheel assembly 17, the E-shaped snap ring 13 and the inner ring 141 of the flanged bearing constitute a movable end. The reverse wheel assembly 17 can only rotate in a direction opposite to a banknote-feeding direction under the action of the one-way bearing 16. Under the action of the flange 152, the one-way bearing stop ring 15 is in contact with only the outer ring of the flanged bearing 14, which allows the stationary end to be separated from the movable end by using the principle that the movements of the inner ring and the outer ring of the flanged bearing 14 are separated, thus, no friction is generated between the stationary end and the movable end, which ensures a free and smooth rotation of the reverse wheel assembly 17, thereby improving the service life of the banknote separating device and ensuring the reliability of its function.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the spirit and scope of the present application, and these improvements and modifications are also deemed to fall into the scope of the present application.

The invention claimed is:

1. A banknote separating device, applicable for a financial self-service equipment, the banknote separating device comprising a banknote separating wheel set and a reverse wheel set for cooperating with the banknote separating wheel set, the reverse wheel set comprising a reverse-wheel-set rotating shaft, a reverse wheel fixing frame, and a reverse wheel assembly, wherein one end of the reverse wheel assembly sequentially passes through an E-shaped snap ring, a flanged bearing, a one-way bearing stop ring and a one-way bearing to be mounted to the reverse wheel fixing frame, wherein the one-way bearing and the reverse wheel fixing frame are coupled by the one-way bearing stop ring to form a stationary rigid body, and the one-way bearing stop ring is in contact with only an outer ring of the flanged bearing.

2. The banknote separating device according to claim 1, wherein an outer peripheral surface of the one-way bearing stop ring is provided with a protruding strip extending in an axial direction of the one-way bearing stop ring, the reverse wheel fixing frame is provided with a groove for fitting with the protruding strip, and in an assembled state, the protruding strip of the one-way bearing stop ring is embedded into the groove of the reverse wheel fixing frame.

3. The banknote separating device according to claim 2, wherein one end of the protruding strip protrudes from a first side of the one-way bearing stop ring, an outer peripheral surface of the one-way bearing is provided with a groove for fitting with the protruding strip, and in the assembled state, the one-way bearing is located at the first side of the one-way bearing stop ring, and an end, protruding from the first side of the one-way bearing stop ring, of the protruding strip is embedded into the groove in the outer peripheral surface of the one-way bearing.

4. The banknote separating device according to claim 3, wherein the one-way bearing stop ring comprises a second side opposite to the first side, an outer peripheral portion of the second side is configured as a flange, and in the assembled state, the flanged bearing is located at the second side of the one-way bearing stop ring, and the flange is in contact with the outer ring of the flanged bearing.

5. The banknote separating device according to claim 1, wherein another end of the reverse wheel assembly sequentially passes through an E-shaped snap ring, a flanged bearing, and a spacer to be mounted to the reverse wheel fixing frame.

6. A reverse wheel set, applicable for a banknote separating device of a financial self-service equipment, the reverse wheel set comprising a reverse-wheel-set rotating shaft, a reverse wheel fixing frame, and a reverse wheel assembly, wherein one end of the reverse wheel assembly sequentially passes through an E-shaped snap ring, a flanged bearing, a one-way bearing stop ring and a one-way bearing to be mounted to the reverse wheel fixing frame, wherein the one-way bearing and the reverse wheel fixing frame are coupled by the one-way bearing stop ring to form a stationary rigid body, and the one-way bearing stop ring is in contact with only an outer ring of the flanged bearing.

7. The reverse wheel set according to claim 6, wherein an outer peripheral surface of the one-way bearing stop ring is provided with a protruding strip extending in an axial direction of the one-way bearing stop ring, the reverse wheel fixing frame is provided with a groove for fitting with the protruding strip, and in an assembled state, the protruding strip of the one-way bearing stop ring is embedded into the groove of the reverse wheel fixing frame.

8. The reverse wheel set according to claim 7, wherein one end of the protruding strip protrudes from a first side of the one-way bearing stop ring, an outer peripheral surface of the one-way bearing is provided with a groove for fitting with the protruding strip, and in the assembled state, the one-way bearing is located at the first side of the one-way bearing stop ring, and an end, protruding from the first side of the one-way bearing stop ring, of the protruding strip is embedded into the groove in the outer peripheral surface of the one-way bearing.

9. The reverse wheel set according to claim 8, wherein the one-way bearing stop ring comprises a second side opposite to the first side, an outer peripheral portion of the second side is configured as a flange, and in the assembled state, the flanged bearing is located at the second side of the one-way bearing stop ring, and the flange is in contact with the outer ring of the flanged bearing.

10. The reverse wheel set according to claim 6, wherein another end of the reverse wheel assembly sequentially passes through an E-shaped snap ring, a flanged bearing, and a spacer to be mounted to the reverse wheel fixing frame.

* * * * *